US007596971B2

(12) United States Patent
Traenkle et al.

(10) Patent No.: US 7,596,971 B2
(45) Date of Patent: Oct. 6, 2009

(54) CIRCULAR KNITTING MACHINE WITH A REPLACEABLE NEEDLE CYLINDER

(75) Inventors: Dietmar Traenkle, Balingen (DE); Bernd Boss, Albstadt (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 12/110,623

(22) Filed: Apr. 28, 2008

(65) Prior Publication Data

US 2008/0264108 A1 Oct. 30, 2008

(30) Foreign Application Priority Data

Apr. 30, 2007 (DE) ..... 10 2007 020 743

(51) Int. Cl.
*D04B 15/00* (2006.01)

(52) U.S. Cl. ..... 66/115; 66/8

(58) Field of Classification Search ..... 66/8, 66/19, 1 R, 114, 115
See application file for complete search history.

(56) References Cited

U.S. PATENT DOCUMENTS 3,757,538 A * 9/1973 Martinetz ..... 66/19
5,099,661 A * 3/1992 Kitagawa ..... 66/19
5,224,360 A * 7/1993 Kawase et al. ..... 66/19
5,649,435 A * 7/1997 Bryant ..... 66/8
6,131,417 A * 10/2000 Plath et al. ..... 66/19

FOREIGN PATENT DOCUMENTS

| | | |
|---|---|---|
| DE | 177577 | 1/1906 |
| DE | 195 33 844 | 3/1997 |
| DE | 196 53 761 | 6/1998 |
| EP | 0 413 608 | 2/1991 |
| EP | 0 436 313 | 7/1991 |
| GB | 505 324 | 5/1939 |

* cited by examiner

*Primary Examiner*—Danny Worrell
(74) *Attorney, Agent, or Firm*—Michael J. Striker

(57) ABSTRACT

The invention relates to a circular knitting machine with a replaceable needle cylinder (7). According to the invention, two or more eccentrics (19) are disposed to be rotatable in a support ring (3) for the needle cylinder (7) or in the needle cylinder itself, and serve the purpose of lifting the needle cylinder (7) out of a normal operating position into a mounting position enabling it to be pulled out laterally, in which an underside of said needle cylinder (7) is arranged at least to be flush with an upper edge of attachments (9) attached to the support ring (3) or elsewhere (FIG. 2).

14 Claims, 7 Drawing Sheets

CIRCULAR KNITTING MACHINE WITH A REPLACEABLE NEEDLE CYLINDER

CROSS-REFERENCE TO RELATED APPLICATION

The invention described and claimed hereinbelow is also described in German Patent Application DE 10 2007 020 743.5 filed on Apr. 30, 2007. This German Patent Application, whose subject matter is incorporated here by reference, provides the basis for a claim of priority of invention under 35 U.S.C. 119(a)-(d).

BACKGROUND OF THE INVENTION

The invention relates to a circular knitting machine with a replaceable needle cylinder, containing a support ring with a supporting surface for the needle cylinder, at least one attachment projecting axially above this and a means to facilitate replacement of the needle cylinder, which has lifting parts acting on the needle cylinder, by means of which the needle cylinder is selectively adjustable into an operating position, in which its lower side lies on the supporting surface and is arranged below an upper edge of the attachment, and into a mounting position, in which its underside is held in a raised position by the lifting parts, so that it is arranged to be at least flush with the upper edge of the attachment. Further, the invention relates to a needle cylinder which can be used in such a knitting machine.

Circular knitting machines with a replaceable needle cylinder have been known for a long time (patent DE 177 577 A). When a circular knitting machine has only one needle cylinder, its insertion and removal is relatively simple. In this case, the insertion and removal can be for the purposes of repair and maintenance as well as for the purpose of operating the same circular knitting machine with needle cylinders of different gauge and/or different diameters. Since the area above the needle cylinder is substantially free, the needle cylinder and possibly the associated support rings only need to be lifted out of the machine frame or inserted into this from the top.

However, the insertion and removal of a needle cylinder from the top is not readily possible if the circular knitting machine additionally has a structural part arranged above the needle cylinder, e.g. a dial or a thread changing device, since a removal of such structural parts would render a virtually complete disassembly of the circular knitting machine necessary. Therefore, for these cases it is already known (patent documents EP 0 413 608 A1, EP 0 436 313 A1) to provide an arrangement, by means of which the relative position between the needle cylinder and the structural part is adjustable in the direction of the needle cylinder axis such that the needle cylinder can be inserted or removed in a direction running vertically to the needle cylinder axis, i.e. selectively with or without the said structural part. However, such an insertion or removal of the needle cylinder is still problematic even when the structural part is sufficiently raised. A reason for this is that the needle cylinder is generally arranged with its lower edge in a recess of the cylinder support ring and/or is provided with additional centring means, which render it necessary to significantly raise the needle cylinder during removal and lower the needle cylinder accordingly during insertion. These movements must be performed manually by the operating personnel concerned with the replacement. As a result, removal and insertion measures are made particularly difficult when the needle cylinder is additionally subject to the weight of a structureal part positioned on it, e.g. a dial.

To prevent these disadvantages, it is known (DE 195 33 844 A1) to generally remove the needle cylinder together with the dial positioned on it and, if this concerns large circular knitting machines, detachably mount the dial on a dial support. Prior to the radial removal of the needle cylinder and the dial, this dial support is lowered down through the needle cylinder by means of a special hoisting device to such a depth that its upper edge comes to lie below the lower edge of the needle cylinder and as a result cannot hinder the radial removal of the needle cylinder.

Finally, a circular knitting machine of the aforementioned type is known (DE 196 53 761), which has means for adjusting the needle cylinder in axial direction in such a way that the needle cylinder can be selectively adjusted into a usual operating position or into a raised mounting position enabling the insertion and removal. These means comprise either lifting jacks, which can be mounted in the support ring of the needle cylinder and can be placed against the underside of the needle cylinder, or lifting rails, which can be mounted between the needle cylinder or the support ring and have non-round cross-sections. While the application of the lifting jacks makes comparatively complicated operations necessary during replacement of a needle cylinder, the replacement of a needle cylinder with the aid of lifting rails is barely possible for a single operator to perform because of the high forces that have to be applied. This applies in particular where comparatively heavy needle cylinders of large circular knitting machines are concerned and dials or other structural parts must be removed together with the needle cylinders. Apart from this, the replacement of a needle cylinder requires a plurality of working steps, as in the case of other known circular knitting machines, and this makes the replacement operation additionally difficult.

SUMMARY OF THE INVENTION

Starting from the above, an object of the invention is to configure the circulator knitting machine of the above-specified type so that the insertion and removal of the knitting cylinder can be performed with a smaller number of working steps.

A further object of the invention is to configure the circular knitting machine mentioned above in such a manner that the exchange of a needle cylinder is substantially simplified.

Yet another object of the invention is to provide a circular knitting machine of the above-specified type such that the exchange of the needle cylinder can be performed with a smaller number of steps and in a simplified manner irrespective of whether it is made with or without a dial or a similar constructural part.

A further object is to provide a needle cylinder which is particularly suitable for a circular knitting machine of the above-specified type.

These and other objects are solved according to this invention by means of a circular knitting machine which is characterised in that the lifting parts contain eccentrics which are arranged between the support ring and the needle cylinder and are disposed to be rotatable around rotational axes arranged transversely to a machine axis, as well as by means of a needle cylinder for such a circular knitting machine having an underside and being characterised in that it is provided on the underside with means intended for cooperating with the eccentrics.

The invention provides the advantage that for removal of a needle cylinder after the usual preparation operations have been conducted, all that is practically required is to lift the needle cylinder into the mounting position by means of the eccentrics and then move it laterally out of the machine, whereas it is sufficient for insertion of a new needle cylinder to place this on the eccentrics and then lower it into the operating position.

Further advantageous features of the invention may be seen from the sub-claims.

The invention is explained in more detail below on the basis of exemplary embodiments in association with the attached drawings.

DETAILED DESCRIPTION OF THE PREFERRED EMBODIMENTS

Figure 1:
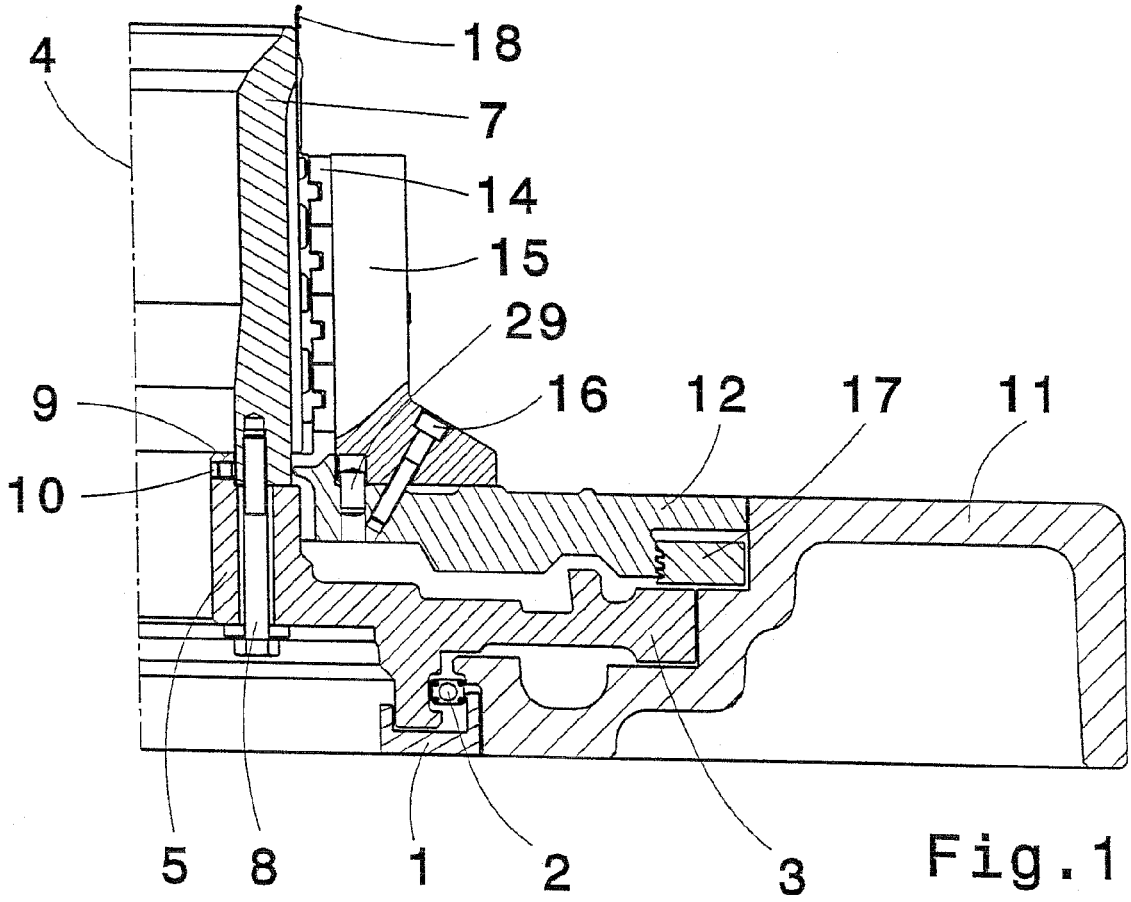
FIG. 1 shows a vertical section through a part of a circular knitting machine.
Figure 2:
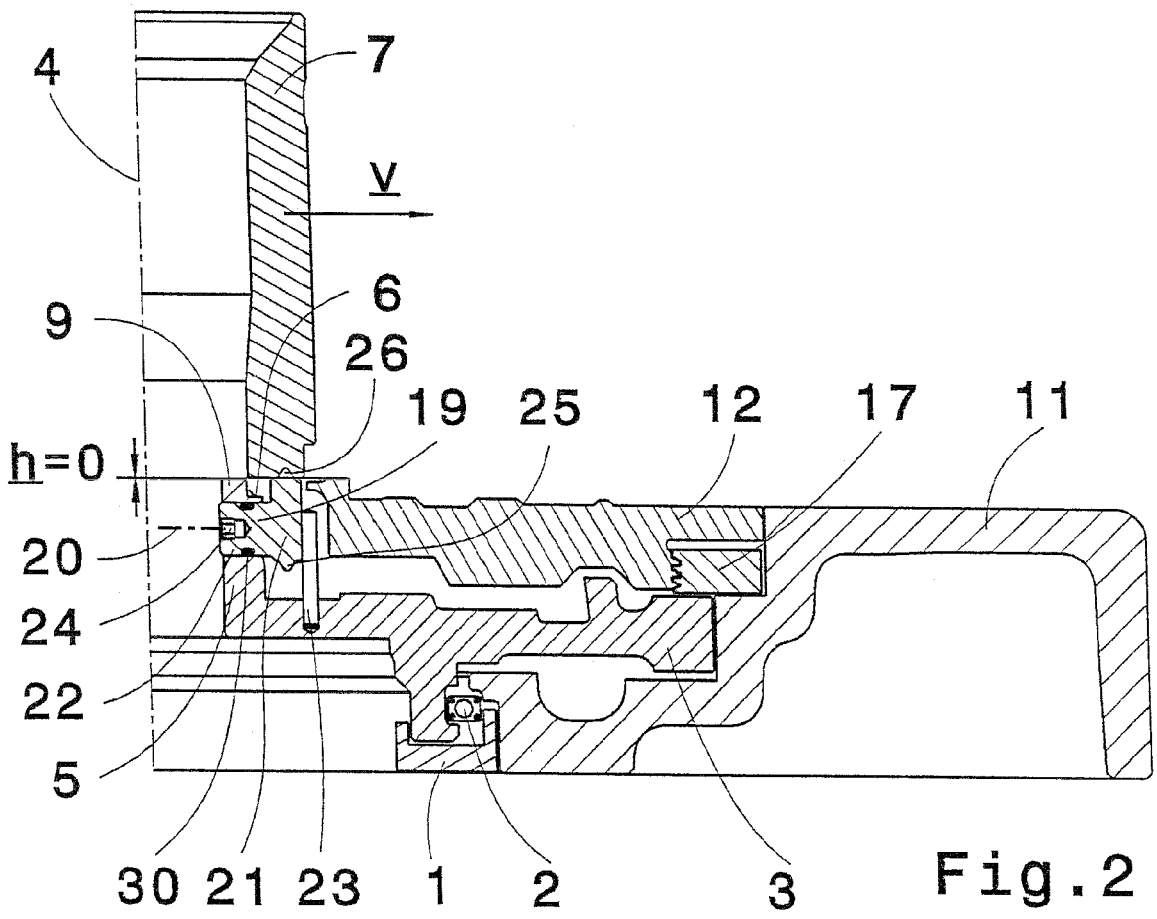
FIG. 2 is a sectional representation similar to FIG. 1, but simplified, of a circular knitting machine according to the invention with a needle cylinder in a mounting position.
Figure 3:
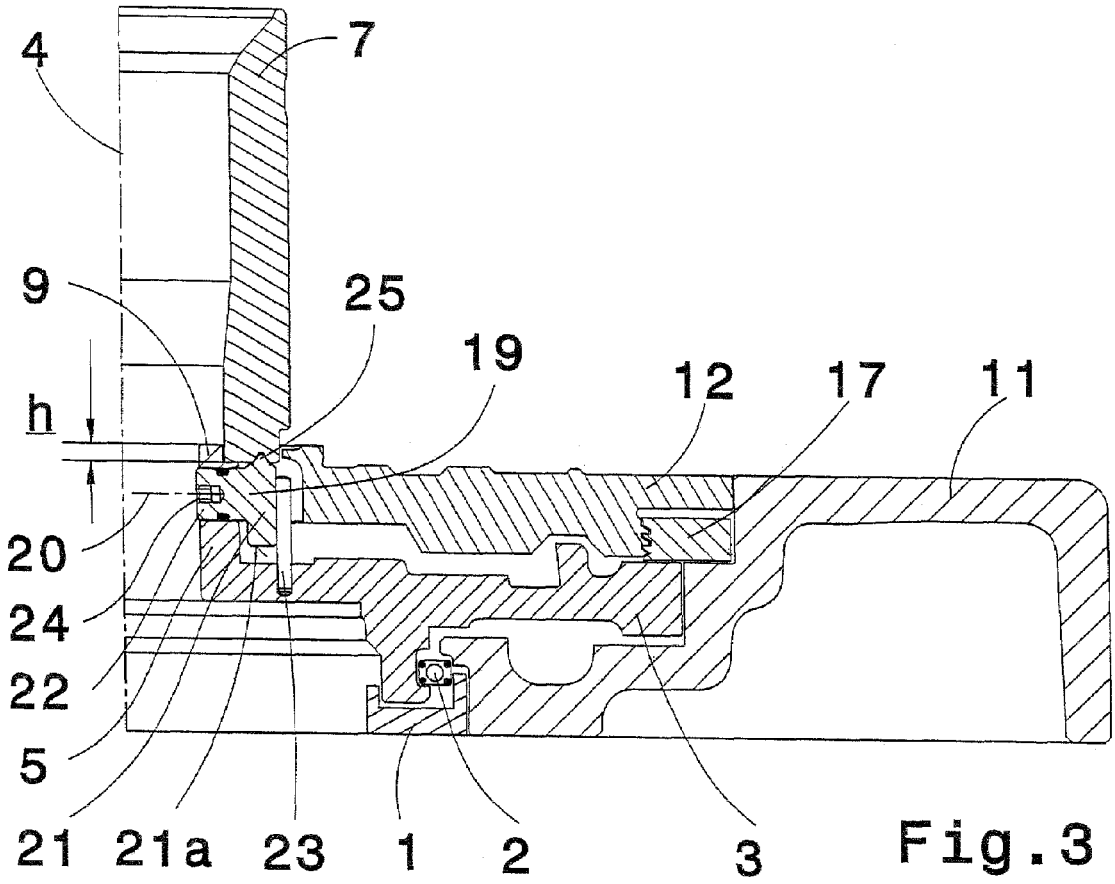
FIG. 3 is a sectional view corresponding to FIG. 2, but wherein the needle cylinder is located in an operating position.

According to FIGS. 1 to 3, in which only the parts essential to the invention are shown, a circular knitting machine includes, as usual, a base plate (not further shown) arranged in a machine frame and on which a bearing ring 1 with bearings 2 is arranged, in which a support ring 3 is disposed to be rotatable around a generally vertical machine axis 4. The support ring 3 is defined on a side located radially on the inside by a vertically arranged side wall 5 coaxially surrounding the machine axis 4 and having a supporting surface 6 (FIG. 2) on its upper side. Supported on this supporting surface 6 is a needle cylinder 7, which is fixedly connected to the support ring 3 with fastening screws 8, which project through bores of the side wall 5 and are screwed into the needle cylinder 7 from the underside.

For precise coaxial centring of the needle cylinder 7 relative to the machine axis 4, the side wall 5 is defined on its upper side by a centring insert 9, which projects upwards beyond the supporting surface 6 and stands opposite the needle cylinder 7 radially from the inside and is a few millimeters high, for example. The centring attachment 9 serves to receive radially arranged centring screws 10 that abut against the needle cylinder 7 from the inside. During the usual actuation of the support ring 3 by means of a drive motor (not shown), the needle cylinder 7 is thus rotated coaxially around the machine axis 4.

In addition, a stationary support ring 11, which bears a cam plate 12, on which usual cam segments 15 provided with cam parts 14 are fastened by means of fastening screws 16, is fastened to the base plate of the circular knitting machine. A set collar 17, which is provided with an internal thread and which is screwed onto a corresponding external thread of the cam plate 12 and is rotatably disposed in the support ring 11, can be used to centrally adjust the vertical position of the cam segments 15 parallel to the machine axis 4.

Usual knitting tools 18, e.g. configured as latch needles in particular, are provided in the needle cylinder 7, which are vertically arranged and can be moved up and down in the usual manner by means of cam parts 14 to process threads (not shown) into stitches.

Figure 4:
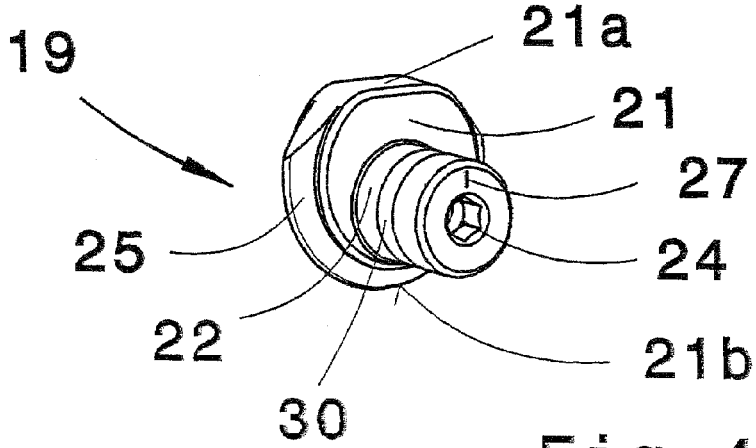
FIG. 4 is an enlarged representation of an eccentric according to the invention.

According to the invention, as FIGS. 2 and 3 show by an exemplary embodiment currently considered to be the best, the rotatable support ring 3 is provided with eccentrics 19, which can be rotated around axes 20 preferably arranged perpendicular to the machine axis 4. On their front sides, as FIG. 4 shows in particular, the eccentrics 19 have substantially circular eccentric discs 21 and are rotatably disposed in the support ring 3. For this purpose, moreover, they are preferably provided with rearward cylindrical attachments 22 projecting radially inwards. These attachments 22 are expediently disposed to be axially loose in bores of the side wall 5 of the support ring 3. To ensure that they do not fall out radially forwards, stop pins 23 are additionally attached in the support ring 3 that are supported against the side of the eccentric discs 21 located radially to the outside.

As FIG. 4 additionally shows, the eccentric discs 21 each have a peripheral section with a preferably plane support face 21*a*. This support face 21*a* is at a longest radial distance from the rotational axis 20 of the eccentric, whereas a diametrically opposed peripheral section 21*b* (FIG. 4) is at a shortest radial distance from the rotational axis 20. The peripheral sections located inbetween have radii that correspondingly increase or decrease.

As FIG. 4 additionally shows, the attachments 22 of the eccentrics 19 are provided on their inner side with a respective means 24 for attaching a tool, e.g. with a hexagonal hole to receive a hexagon key. In the mounted state of the eccentrics 19 (FIGS. 2 and 3), these means 24 are accessible from the inner side of the needle cylinder 7.

Finally, the eccentric discs 21 are preferably provided with a centring rib 25 configured on the periphery, as is evident from FIGS. 2 and 3. This centring rib 25 extends in particular along the peripheral section 21*b* of the eccentric disc 21, which is at the shortest distance from the eccentric rotational axis 20, and serves the purpose of engaging into a centring groove 26 (FIG. 2) when the eccentric 19 is rotated into an operating position evident from FIG. 3. Said centring groove is machined from below into the underside of the needle cylinder 7 and is arranged circumferentially around the needle cylinder or machine axis 4.

Figure 5:
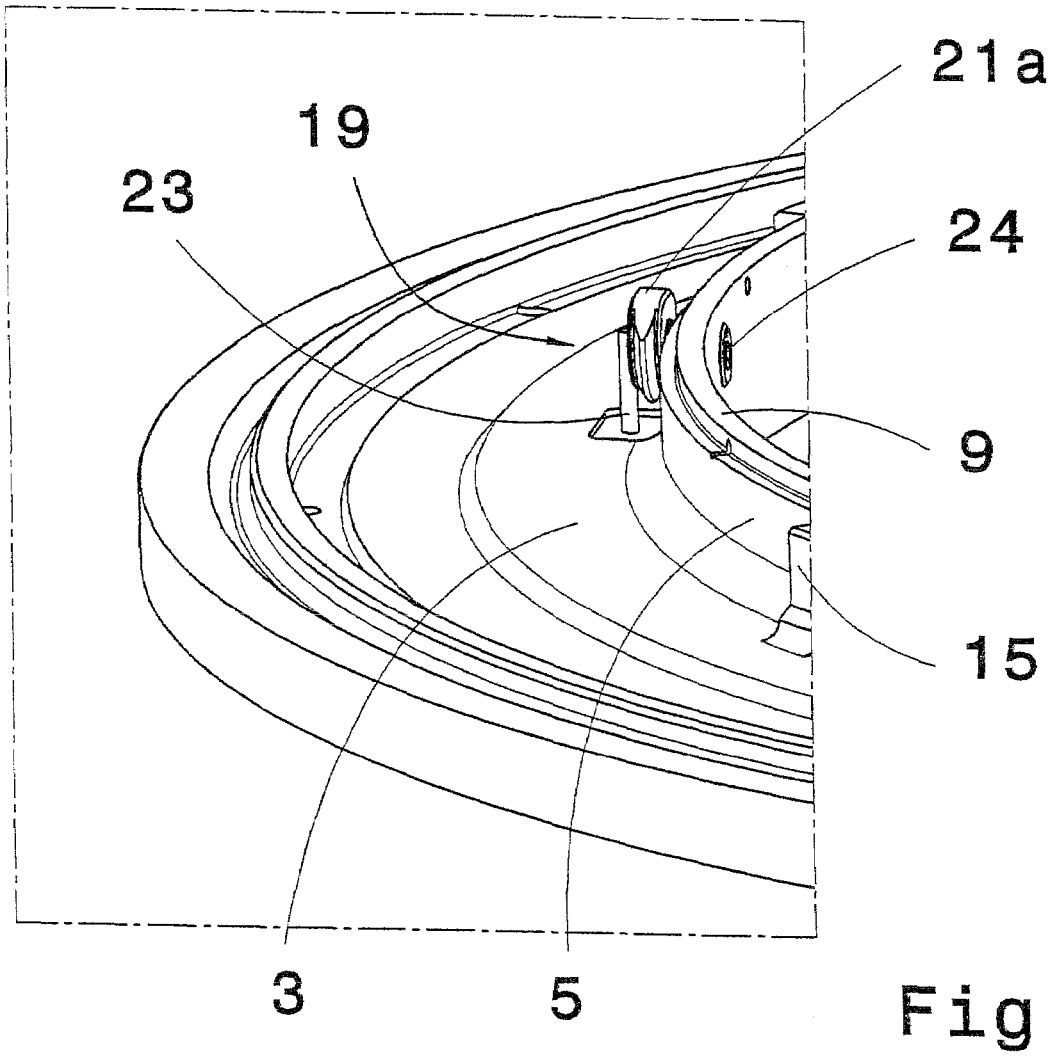
FIG. 5 is a schematic perspective view from above onto an eccentric installed into the circular knitting machine with a cam plate omitted.

FIG. 5 shows that only few eccentrics 19 are present on the periphery of the rotatable support ring 3. Particularly advantageously, only two eccentrics 19 are provided that are diametrically opposed, i.e. offset approximately 180° on the periphery. These are preferably arranged so that they can be operated by a single operator, possibly each with one hand and simultaneously.

Figures 6, 7:
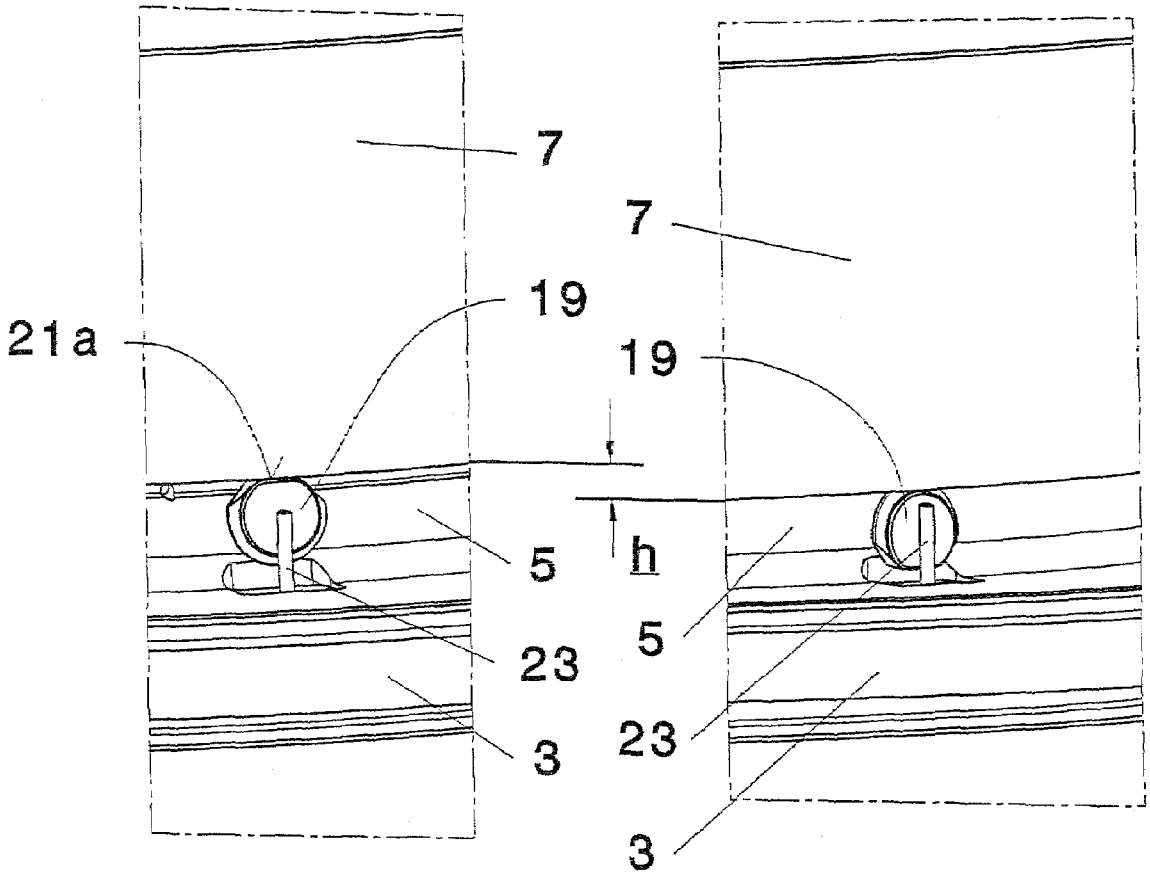
FIG. 6 is a side view of the part of the circular knitting machine shown in FIG. 5 with the eccentric located in mounting position.
FIG. 7 is a view corresponding to FIG. 6 with the eccentric located in operating position.

The removal and insertion of the needle cylinder 7 of the circular knitting machine according to FIGS. 1 to 5 can be performed in the following manner:

Firstly, the centring screws 10 and also the fastening screws 8, by means of which the needle cylinder 7 is held and centred on the support ring 3 in its usual operating position, which it assumes when knitting operations are performed with the circular knitting machine, are released from below. This operating position is shown in FIGS. 3 and 7. The preferably two eccentrics 19 assume a rotational position in the operating position such that the peripheral sections 21*b* are located at the top and therefore the centring ribs 25 are arranged in the centring grooves 26 of the needle cylinder 7, whereas the support faces 21*a* point downwards. Since the peripheral sections 21*b* are at their shortest distance from the eccentric rotational axis 20, the needle cylinder 7 is located in its axially lowest position, in which its underside lies substantially on the supporting surface 6 of the support ring 3 and therefore has the centring attachment 9 projecting above it. Therefore, between the upper edge of the centring attachment 9 and the underside of the needle cylinder 7 there results a distance h according to FIG. 3 that is also indicated schematically in FIG. 7.

After release of the screws 8 and 10, the two eccentrics 19 are rotated preferably by precisely 180° around their rotational axes 20. The precise rotational positions can be checked, for example, by a respective marking 27 made on the inner sides of the attachments 22 (FIG. 4). The rotation of the two eccentrics 19 occurs simultaneously as far as possible to allow the needle cylinder 7 to be lifted without tilting, and ends so that the support faces 21*a* lie at the top and the peripheral sections 21*b* lie at the bottom (FIGS. 2 and 6).

The rotation of the eccentrics 19 around 180° causes the needle cylinder 7 to now be raised into the mounting position shown in FIGS. 2 and 6, in which the dimension h essentially amounts to zero. This means that the preferably plane underside of the needle cylinder 7 is substantially arranged at the same height or flush with the upper edge of the centring attachment 9. In other words, the distances of the support faces 21*a* from the rotational axes 20 of the eccentrics 19 substantially correspond to the height, at which the centring attachment 9 projects upwards beyond the supporting surface 6 of the support ring 3.

In the mounting position, the needle cylinder 7 can now be radially displaced (arrow v in FIG. 2), wherein the centring attachment 9 serves as sliding surface. A previous further raising or lowering of the needle cylinder 7 beyond the dimension adjusted with the eccentric 19 is not necessary. However, the centring attachment 9 and/or the underside of the needle cylinder 7 could be provided with recesses, which allow the insertion of mounting rails, on which the needle cylinder 7, possibly after the eccentrics 19 are rotated slightly back or further, is moved out of the circular knitting machine, as is known per se (e.g. DE 196 57 761 B4). In this case, the dimension h would expediently be slightly larger than the height of the centring attachment 9.

The subsequent installation of another needle cylinder, which has the same diameter, for example, but a different needle gauge, is achieved by conducting the described process steps in the reverse order. As soon as the underside of the needle cylinder 7 lies on the support faces 21*a* of the eccentrics 19, these can be rotated back or further in order to lower the needle cylinder 7 into the normal operating position on the basis of its gravity. The invention preferably provides the advantage here that while the eccentrics are rotated back or further, the centring ribs 25 gradually move into the centring groove 26 of the needle cylinder 7 and thus already centre this substantially radially with respect to the machine axis 4. Thus, once the needle cylinder 7 has reached the operating position (FIGS. 3 and 7), only a final fine adjustment needs to be made by means of the centring screws 10 that is possible because of a slight play between the centring groove 26 and the centring ribs 25. Finally, the fastening screws 8 are then mounted and tightened in order to secure the new cylinder 7 in its operating position.

It is evident from the above description that the replacement operation can be completed with few manual actions and generally by a single operator, in particular if the leverage that becomes effective during the rotation of the eccentrics 19 is matched to the weight of the needle cylinder 7 and possibly further structural parts.

Figure 8:
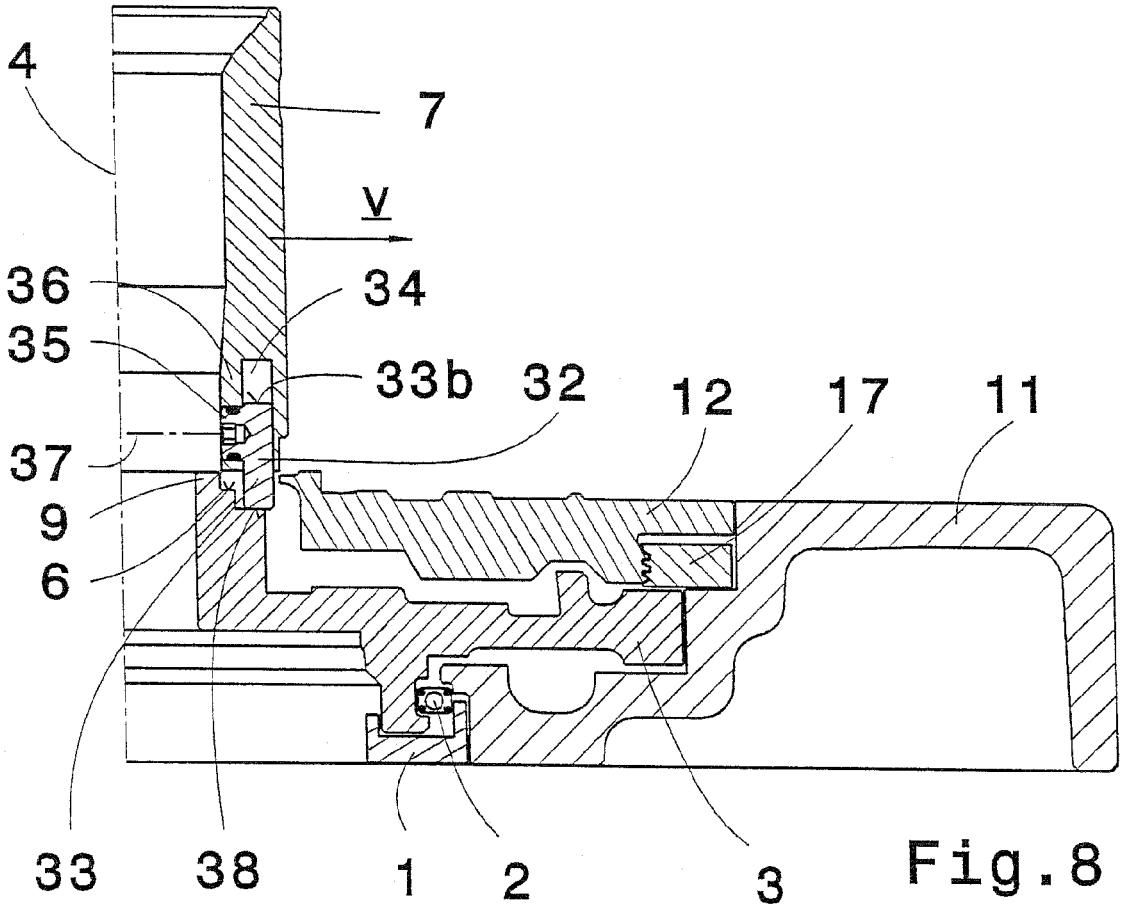
FIGS. 8 and 9 are representations corresponding to FIGS. 2 and 3 of a second exemplary embodiment of the invention.
Figure 9:
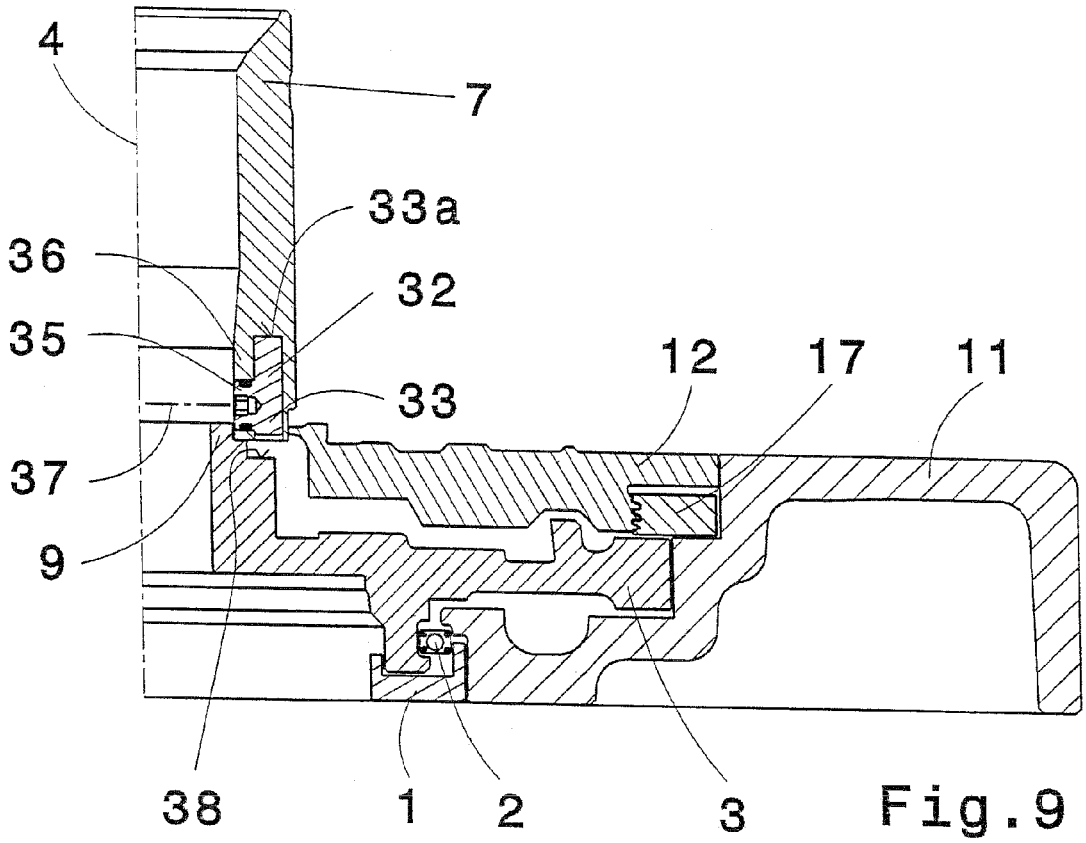
Figure 10:
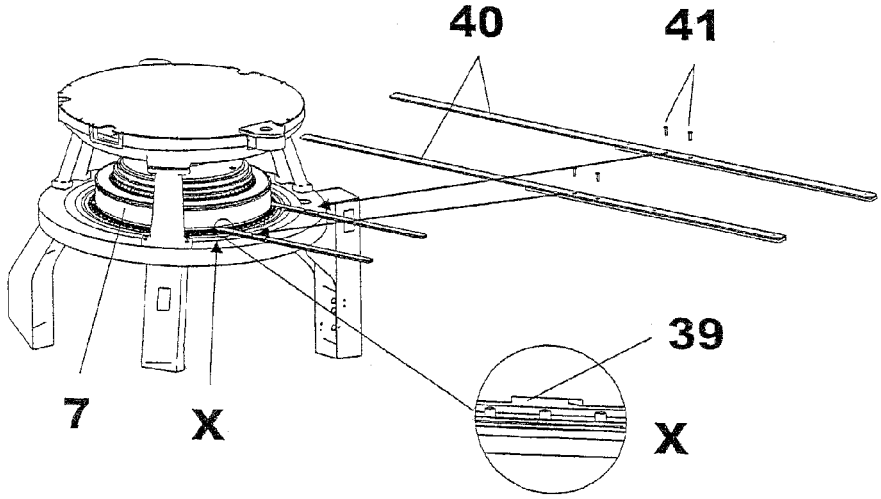
FIG. 10 is a schematic perspective representation of an exemplary application of the exemplary embodiment according to FIGS. 8 and 9 as well as an enlarged detail X thereof.

Whereas in the exemplary embodiment according to FIGS. 1 to 7 the eccentrics 19 are rotatably disposed in the side wall 5 of the support ring 3, FIGS. 8 to 10 show an exemplary embodiment with eccentrics 32 that are rotatably disposed in the needle cylinder 7. Identical parts in FIGS. 8 to 10 have been provided with the same reference numerals as in FIGS. 1 to 7.

According to FIGS. 8 and 9 the eccentrics 32, like eccentrics 19, each have an eccentric disc 33, which is arranged in a recess 34 (FIG. 8) machined into the needle cylinder 7 from its underside. Moreover, the eccentrics 32 are provided with These attachments 35 are rotatably disposed in bores configured in lower side walls 36 of the needle cylinder 7, which define the recesses 34 on their radially inner side. To insert the attachments 35 into the recesses 34, the side wall of the needle cylinder 7 defining these on the radially outer side can be detachably connected to said needle cylinder. Alternatively, it would also be possible to configure the eccentrics 32 in two parts.

Otherwise, the arrangement in FIGS. 8 and 9 is substantially identical to that according to FIGS. 1 to 7, i.e. the eccentric discs 33 have a peripheral section preferably configured as support face 33*a* (FIG. 9) at a comparatively long distance from a rotational axis 37 and a diametrically opposed peripheral section 33*b* (FIG. 8) at a comparatively short distance from the rotational axis 37. The support faces 33*a*, like support faces 21*a* in FIG. 2, serve the purpose of selectively lifting the needle cylinder parallel to the machine axis 4 into a mounting position (FIG. 8), in which its underside is arranged substantially flush with the upper edge of the centring attachment 9 and in which the support faces 33*a* project downwards out of the recesses 34, or can be lowered on the basis of its gravity into an operating position (FIG. 9), in which its underside lies on the supporting surface 6 of the support ring 3 and in which the eccentrics 32 are fully retracted into the recesses 34. A difference from FIGS. 2 and 3 is merely that the needle cylinder 7 according to FIG. 8 is held in the mounting position by the eccentric discs 33 being supported at their support faces 33*a* on a support surface 38, best seen from FIG. 8, which is configured radially outside the supporting surface 6 for the needle cylinder 7 on the support ring 3, and that the needle cylinder 7 is held axially in the raised position by the attachments 35. In contrast, the needle cylinder 7 in FIG. 2 is held in the mounting position by the attachments 22 of the eccentrics 19 being held axially in bores of the support ring 3 arranged radially to the machine axis 4 and the needle cylinder being supported at its underside on the support faces 21*a* of the eccentric discs 21. What both exemplary embodiments have in common is that the support faces 21*a*, 33*a* of the eccentrics 19, 32 serve to create the mounting position.

The rotation of the eccentrics 32 occurs in a similar manner to the exemplary embodiment according to FIGS. 1 to 7 and also the replacement operation is conducted in the same manner as explained in detail above. The only addition is that the eccentrics 32 must be rotated back again into the position seen in FIG. 9 after first sliding onto the centring attachment 9.

FIG. 10 shows that the needle cylinder 7 can be provided on its underside with additional recesses 39, which serve to receive or for subsequent insertion of the mounting rails already mentioned above and indicated here with the reference 40. When using these mounting rails 40, in the mounting position the needle cylinder 7 expediently stands so far above the centring attachment 9 (or other raised parts of the support ring 3 and/or the cam plate 12) that the mounting rails 40 can easily be inserted into the recess 39. Depending on the design, it can also be expedient here to adjust the cam plate into its lowest position by means of the set collar 7 before the replacement operation. Then, the eccentrics 32 can be rotated back or further to deposit the needle cylinder 7 onto the mounting rails 40. Moreover, a preferred variant provides that the mounting rails 40 are fastened to the support ring 3 by means of fastening screws 41 at least for the replacement operation, so that they do not slip radially or laterally during displacement of the needle cylinder 7.

The invention is not restricted to the described exemplary embodiment, which can be modified in a variety of ways. This applies in particular to the configuration and the position of the eccentrics 19 provided in the individual case. Instead of two eccentrics 19, for example, three eccentrics 19 each displaced 120° or four eccentrics each displaced 90° can be provided, where necessary. Moreover, the invention is not restricted to circular knitting machines with rotatable needle cylinders, but is also applicable in the same manner to circular knitting machines with stationary needle cylinders and rotatable cam parts. Furthermore, it is clear that the usual preparations must be made prior to the replacement of a needle cylinder, which include in particular the removal of the cam segments 15, any sinker ring present or a thread guide that hinders the replacement operation. Moreover, any dial present can be detached in a manner known per se and placed on the upper edge of the needle cylinder. Depending on the design provided in the individual case, it may also be necessary to centrally lower the cam plate 12 by means of the set collar 17, if in the normal operating position the cam plate 19 in accordance with FIGS. 1 and 3 is arranged at a distance of more than dimension h above the upper edge of the needle cylinder 7 in order to thus create space for the radial displacement of the needle cylinder 7 (cf. FIG. 2 here). It is additionally clear that any centring pins 29 present (FIG. 1) for the cam segments 15 should be attached in such a way that they do not prevent the needle cylinder 7 from being pulled away laterally. In addition, the attachments 22 of the eccentrics 19 can be provided with rubber rings 30 set in circumferential grooves (FIGS. 2 and 4), said rings abutting against the associated bore walls and serving to axially clamp the attachments 22. Finally, it is understood that the different features can also be applied in other combinations than those described and represented.

It will be understood, that each of the elements described above or two or more together, may also find a useful application in other types of construction differing from the types described above.

While the invention has been illustrated and described as embodied in a circular knitting machine and a needle cylinder therefor, it is not intended to be limited to the details shown, since various modifications and structural changes may be made without departing in any way from the spirit of the present invention.

Without further analysis, the forgoing will so fully reveal the gist of the present invention that others can, by applying current knowledge, readily adapt it for various applications without omitting features that, from the standpoint of prior art, fairly consitute essential characteristics of the generic or specific aspects of this invention.

What is claimed is:

1. Circular knitting machine comprising: a replaceable needle cylinder (7) have an underside, support ring (3) having a surface (6) for supporting said underside of said needle cylinder (7), at least one attachment (9) projecting axially above said underside, and means for facilitating replacement of the needle cylinder (7), said means having lifting parts comprising eccentrics (19, 32) with cylindrical projections (22, 35), wherein said eccentrics (19, 32) are arranged between said support ring (3) and said needle cylinder (7), wherein said projections (22, 35) are rotatably disposed in bores of an element selected from the group consisting of said support ring (3) and said needle cylinder (7), and wherein said eccentrics (19, 32) are rotatable around rotational axes (20, 37) arranged transversely to a machine axis (4) for selectively adjusting said needle cylinder (7) into an operating position, in which said underside lies on said supporting surface (6) and is arranged below an upper edge of said centering shoulder (9), and into a mounting position, in which said underside is held in a raised position by said lifting parts, so that said underside is arranged to be at least flush with said upper edge of said centering shoulder (9).

2. Circular knitting machine according to claim 1, wherein said bores are configured in a side wall (5) which defines said support ring (3) on a radially inner side of said needle cylinder (7).

3. Circular knitting machine according to claim 1, wherein said support ring (3) is provided with stop pins (23) associated with said eccentrics (19).

4. Circular knitting machine according to claim 1, wherein said eccentrics (19, 32) are provided with means (24) for attaching a tool.

5. Circular knitting machine according to claim 4, wherein said means (24) for attaching a tool are accessible from said inner side of said needle cylinder (7).

6. Circular knitting machine according to one of claim 1, wherein said underside of said needle cylinder (7) has a circumferential centring groove (26) and said eccentrics are provided with centring ribs (25) engaging into said centring groove (26).

7. Circular knitting machine according to claim 6, wherein said centring ribs (25) are configured on said eccentrics (19) so that they only engage into said centring groove (26) in said operating position of said needle cylinder (7).

8. Circular knitting machine according to claim 1, wherein said needle cylinder (7) has a side wall (36) defining recesses (34) open towards said underside, wherein said eccentrics (32) are arranged in said recesses (34) and wherein said bores receiving said attachments (35) are configured in said side wall (36).

9. Circular knitting machine according to claim 1, and having only two said eccentrics (19), which are substantially diametricaiiy opposed to the another.

10. Circular knitting machine according to claim 1, wherein in said mounting position said underside of said needle cylinder (7) is arranged substantially at a same height as said upper edge of said centring attachment (9).

11. Needle cylinder for a circular knitting machine of claim 1, comprising the underside and being provided on said underside with means for cooperating with said eccentrics (19, 32).

12. Needle cylinder according to claim 11, wherein said means contain at least one centring groove (26) suitable for receiving one of said centring ribs (25) of said eccentrics (19).

13. Needle cylinder according to claim 11, wherein said means include at least two recesses (34), for a rotatable mounting of a respective eccentric (32) and defined on radially inner sides by said side wall (36), said side wall (36) having bores to receive said projections.

14. Needle cylinder according to one of claims 11 to 13, wherein said underside is provided with recesses (39) for receiving support rails (40).

* * * * *